US009004076B2

(12) United States Patent
Le

(10) Patent No.: US 9,004,076 B2
(45) Date of Patent: Apr. 14, 2015

(54) METHOD FOR EXTENDING EYELASHES TO ACHIEVE A PARTICULAR LOOK

(76) Inventor: Jessica Le, Houston, TX (US)

( * ) Notice: Subject to any disclaimer, the term of this patent is extended or adjusted under 35 U.S.C. 154(b) by 0 days.

(21) Appl. No.: 13/586,886

(22) Filed: Sep. 10, 2012

(65) Prior Publication Data

US 2014/0069449 A1 Mar. 13, 2014

(51) Int. Cl.

| | |
|---|---|
| ***A41G 5/00*** | (2006.01) |
| ***A41G 3/00*** | (2006.01) |
| ***A45D 40/30*** | (2006.01) |
| ***A41G 5/02*** | (2006.01) |

(52) U.S. Cl.
CPC .. *A41G 5/02* (2013.01); *A41G 5/00* (2013.01); *A45D 40/30* (2013.01)

(58) Field of Classification Search
CPC ..... A41G 3/0075; A41G 3/00; A41G 5/00; A41G 5/02; A41G 5/004; A41G 5/008; A41G 5/0053; A45D 40/30
USPC ..... 132/201, 53–56, 216, 217, 218, 207, 132/333, 212, 200, 319; 446/393, 394; 119/600, 601, 607
See application file for complete search history.

(56) References Cited

U.S. PATENT DOCUMENTS

| | | | | |
|---|---|---|---|---|
| 3,557,653 | A * | 1/1971 | Kim | 83/522.19 |
| 3,833,007 | A * | 9/1974 | Jacobs | 132/53 |
| 7,600,519 | B2 * | 10/2009 | Dinh | 132/201 |
| 8,127,774 | B2 * | 3/2012 | Dinh | 132/201 |
| 8,225,800 | B2 * | 7/2012 | Byrne | 132/216 |
| 2005/0061341 | A1 * | 3/2005 | Choe | 132/53 |
| 2007/0023062 | A1 * | 2/2007 | McKinstry et al. | 132/201 |
| 2007/0227550 | A1 * | 10/2007 | Merszei | 132/53 |
| 2007/0272264 | A1 * | 11/2007 | Byrne | 132/201 |
| 2007/0295353 | A1 * | 12/2007 | Dinh | 132/216 |
| 2009/0235950 | A1 * | 9/2009 | Dinh | 132/216 |
| 2010/0170526 | A1 * | 7/2010 | Nguyen | 132/201 |
| 2012/0055499 | A1 * | 3/2012 | Sanbonmatsu | 132/201 |
| 2012/0145173 | A1 * | 6/2012 | Dinh | 132/200 |
| 2012/0180804 | A1 * | 7/2012 | Hochi et al. | 132/53 |
| 2013/0213427 | A1 * | 8/2013 | Dinh | 132/201 |

OTHER PUBLICATIONS http://www.youtube.com/watch?y=Z9zRCFkyWil (Jul. 28, 2011).*
http://www.catandoco.com.au/About-Lashtopia-Eyelash-Extension-18.html (2012).*

* cited by examiner

*Primary Examiner* — Vanitha Elgart
(74) *Attorney, Agent, or Firm* — Spradley PLLC; Michael Spradley

(57) ABSTRACT

A method of sectioning eyelashes into zones is disclosed. A method of sectioning eyelashes into zones comprises dividing a surface of an eyelid into zones and applying extension lashes to natural lashes within the zones. Zones can comprise an inner zone, a mid-zone and an outer zone. Furthermore, at least a portion of extension lashes within inner zone can have a first length, while the extension lashes within middle zone and outer zone can have a second and third length, respectively.

14 Claims, 10 Drawing Sheets

METHOD FOR EXTENDING EYELASHES TO ACHIEVE A PARTICULAR LOOK

BACKGROUND

This disclosure relates to an improved method for extending eyelashes to achieve a particular look.

Methods for enhancing eyelashes have evolved over the years. Having thick or dark eyelashes can give a person a more feminine and youthful appearance. Additionally, defined and dark eyelashes can make a person's eye appear larger and attractive. Eye mascara is used to darken, thicken, lengthen, curl or redefine eyelashes. Specifically, mascara can have liquid, cake, or cream forms that can have different formulas. However, mascara is a form of cosmetic that lasts only a few hours. Furthermore, each application of mascara can be time-consuming to achieve the desired look for the eyelashes. Additionally, chemicals in mascara can sometimes damage the lashes, causing them to become dry and brittle. Moreover, mascara is more likely create blots or make the lashes appear caked when too much product is applied.

A popular alternative known as false eyelashes has been developed to enhance the appearance of eyelashes. False eyelashes usually come in a small package, which contain strips of fake lashes, and a sticky adhesive. The sticky adhesive can be applied to synthetic lashes and the full strip of lashes can be attached to the upper eyelid with the aid of tweezers. However, this process can be messy, because excess adhesive can scatter around the eyelid. Moreover, eyes can feel heavy and tired with a full cluster of synthetic eyelashes applied on the eyelid. Additionally, bundled fake eyelashes can be applied to multiple natural lashes, multiple lashes end up bonded together. This can permanently damage the cluster of eyelashes.

Given the complexity of applying lashes, self-application of fake lashes can also be difficult. Due to the high time-consumption of applying the full strip of fake lashes into the natural lash line, lashes can be improperly applied because of quickly drying adhesive. Furthermore, even after proper placement, false eyelashes can still appear fake and stiff.

A more recent alternative to fake lashes administered in a strip is having a lash technician glue individual lashes to real lashes. In such method, the lash technician typically has a small bowl of loose lashes and a jar of glue. The technician separates a lash from the bowl of lashes and grabs it with tweezers, dips an end of the lash in glue, and applies it to the client. However, such process must be done for each individual lash and can be quite time consuming, taking an hour or more to apply a set of lash extensions.

It would therefore be advantageous to have an improved method for extending eyelashes.

SUMMARY

A method of sectioning eyelashes is described herein. Specifically, a method of sectioning eyelashes into zones is disclosed. A method of sectioning eyelashes into zones comprises dividing a surface of an eyelid into zones and applying extension lashes to natural lashes within said zones. Zones can comprise an inner zone, a mid-zone and an outer zone. In addition, at least a portion of extension lashes within inner zone can have a first length, while the extension lashes within said middle zone and outer zone can have a second and third length, respectively.

Additionally, in one embodiment, the method of sectioning eyelashes can include an inner zone extending from a tear duct to an iris, a middle zone spanning across an iris, and an outer zone reaching from an iris to the end of an eyelid. Furthermore, an inner zone can be further divided into a first inner zone and a second inner zone. First inner zone can comprise lash extensions of a first length, while second inner zone can comprise lash extensions of a fourth length.

DETAILED DESCRIPTION

Described herein is a system and method for extending eyelashes. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
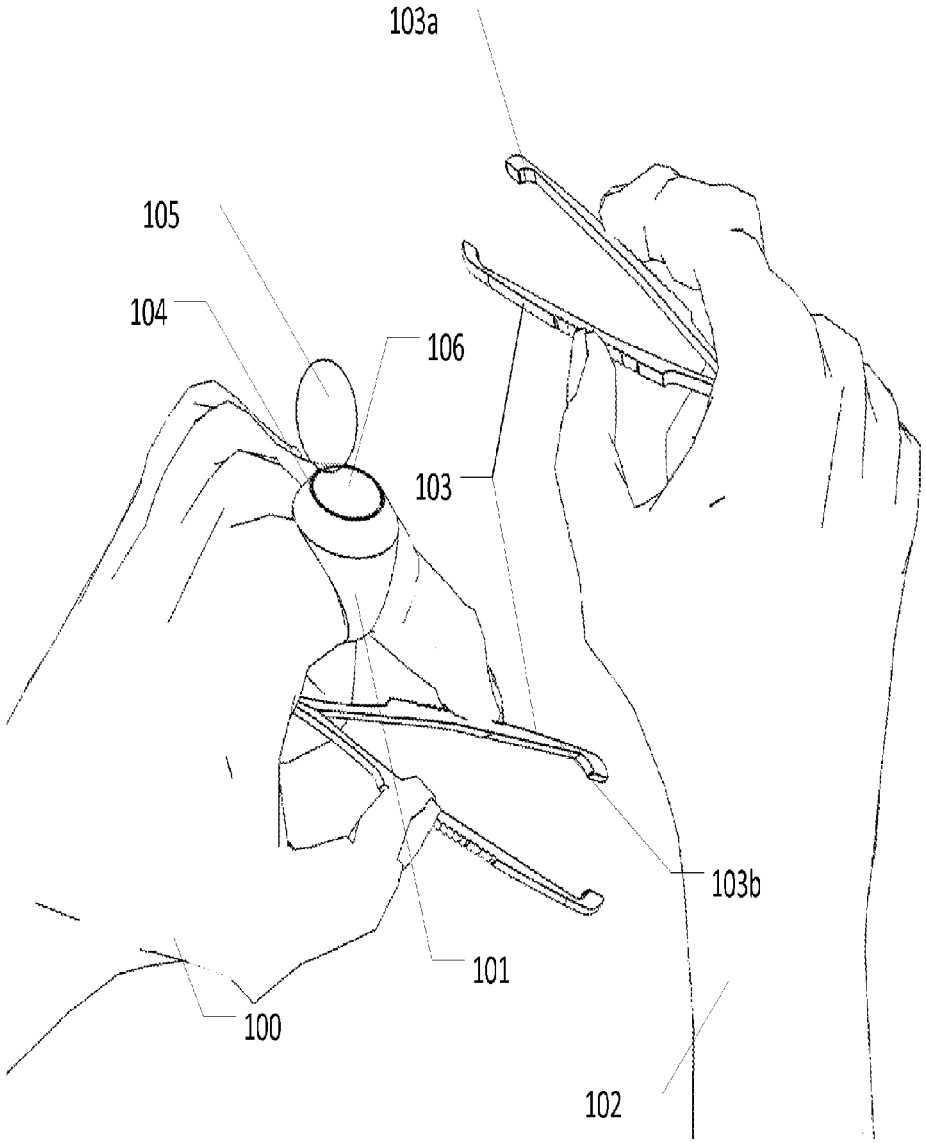
FIG. 1 illustrates a first hand wearing a ring, and a second hand holding forceps.

FIG. 1 illustrates a first hand 100 wearing a ring 101, and a second hand 102 holding forceps 103. Ring 101 can be a circular band that can be worn around a finger. Ring 101 can be made of any materials such as plastic, metal and/or glass that can be designed in various color, shape, and/or sizes. Forceps 103*a* and 103*b* can be any tools, such as tweezers, which can be used for manipulating natural lashes and lash extensions.

Furthermore, ring 101 can comprise a container 104, and a lid 105. Container 104 can be used for storing glue 106. Glue 106 can be made of a sticky and/or liquid adhesive material for adhering a prosthetic lash to a natural lash. In one embodiment, container 104 can be a concave portion at the top surface of ring 101. In such embodiment, ring 101 and container 104 can be molded as a single device. In another embodiment, container 104 can be a small receptacle attached to ring 101 through weld, solder, glue or other method known in the art. Lid 105 can cover or seal container 104.

Figure 2:
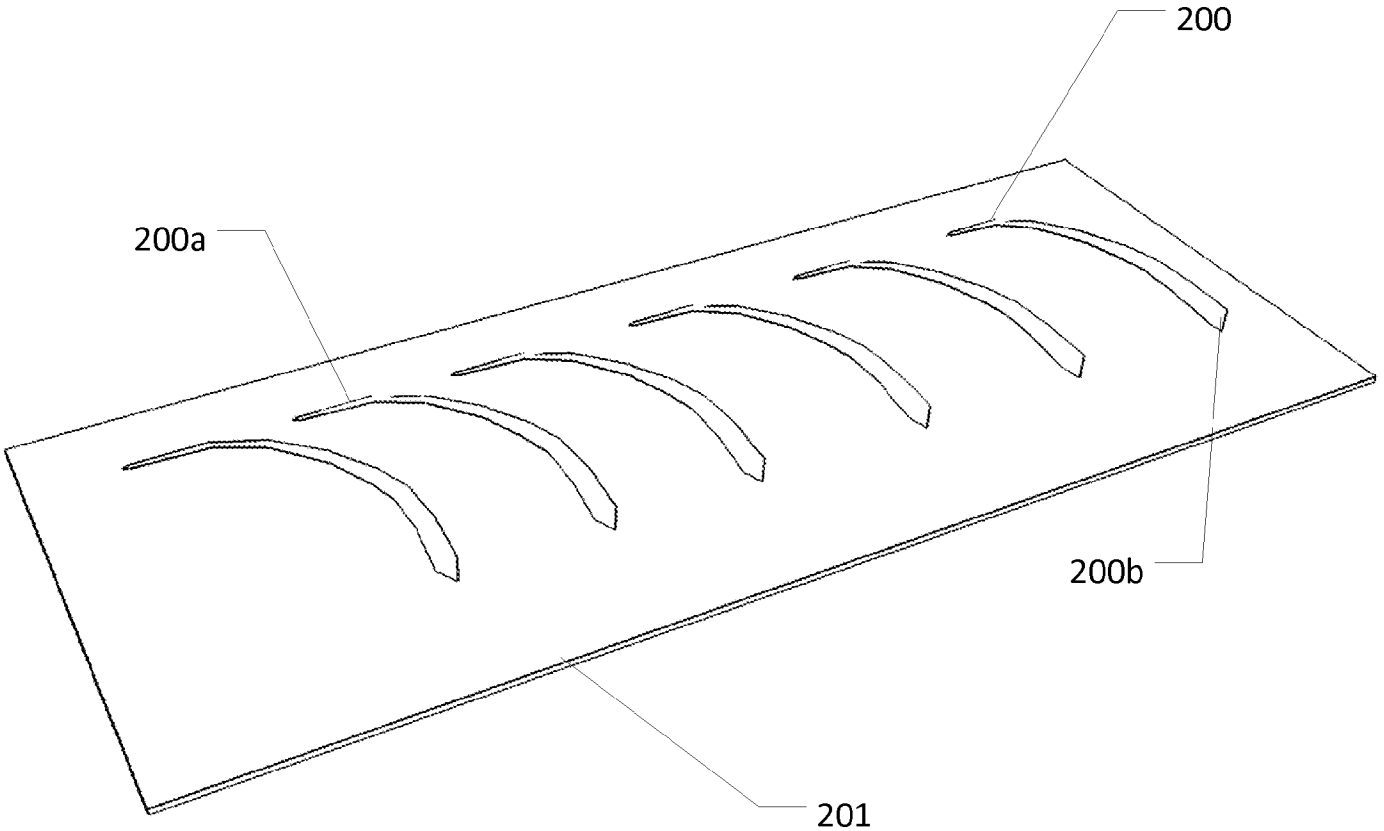
FIG. 2 illustrates a plurality of extension lashes attached to tape.

FIG. 2 illustrates a plurality of extension lashes 200 attached on a piece of tape 201. Extension lashes 200 can be designed with various length, thickness, color, and/or curl. Extension lashes 200 can be divided into two parts, a base 200*a*, and a tip 200*b*. Base 200*a* can be the thicker part of extension lashes 200, while tip 200*c* can be thinner end of extension lashes 200. Base 200*a* can be the portion of extension lashes 200 that can be adhered onto a natural lash.

As a non-limiting example, extension lashes 200 can have a length that is between 1 to 30 millimeters. As another non-limiting example, extension lashes 200 can have a thickness that is between 0.01 to 0.25. As another non-limiting example, extension lashes 200 can have various curls, which can range between straight, curled, and extra-curled. Tape 201 can be any strip of material capable holding eyelashes in an orderly manner and maintaining a fixed position during extension lash 200 removal from tape and installation onto user. In one embodiment, tape 201 can comprise tape adhesive on one or both sides.

Figure 3:
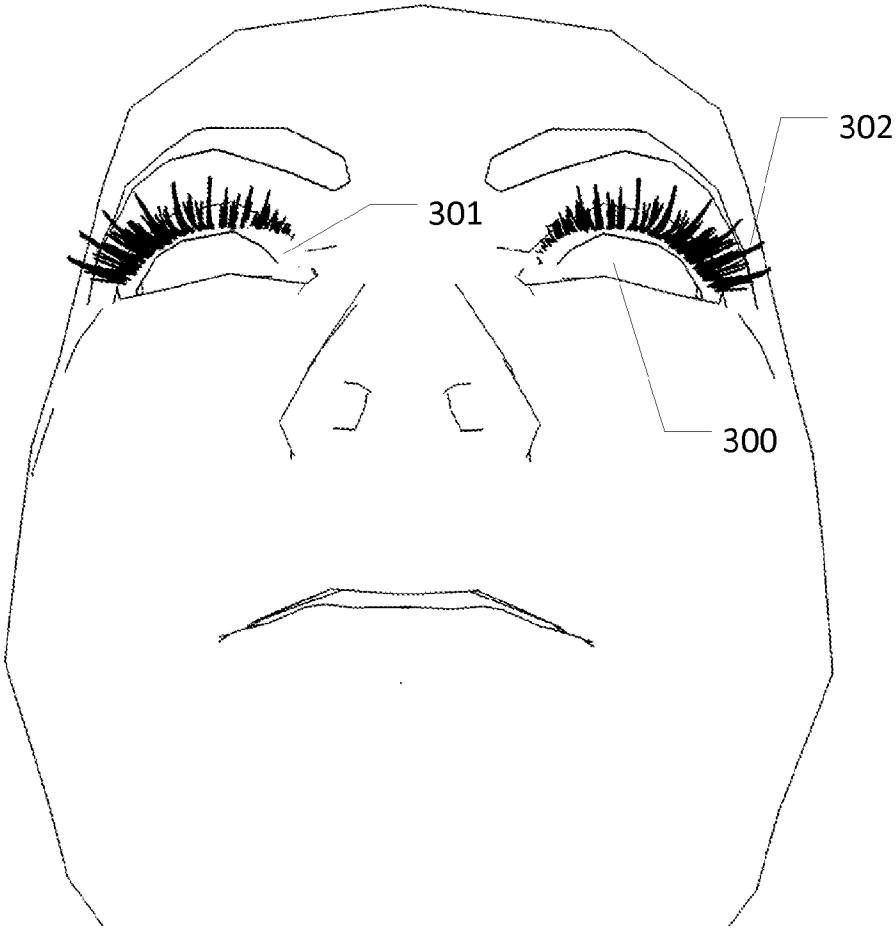
FIG. 3 illustrates a plurality of eyelashes on a face.

FIG. 3 illustrates a human face comprising eyes 300. Eyes 300 can comprise eyelids 301, and a plurality of eyelashes 302. Eyes 300 can have different types, as eyes 300 vary in shapes and sizes such as, but not limited to, almond-shaped, oval-shaped, round-shaped, small and/or big eyes. Eyelids 301 can be divided into zones, in which extension lashes 200 can be attached in order to create different looks.

Figure 4A:
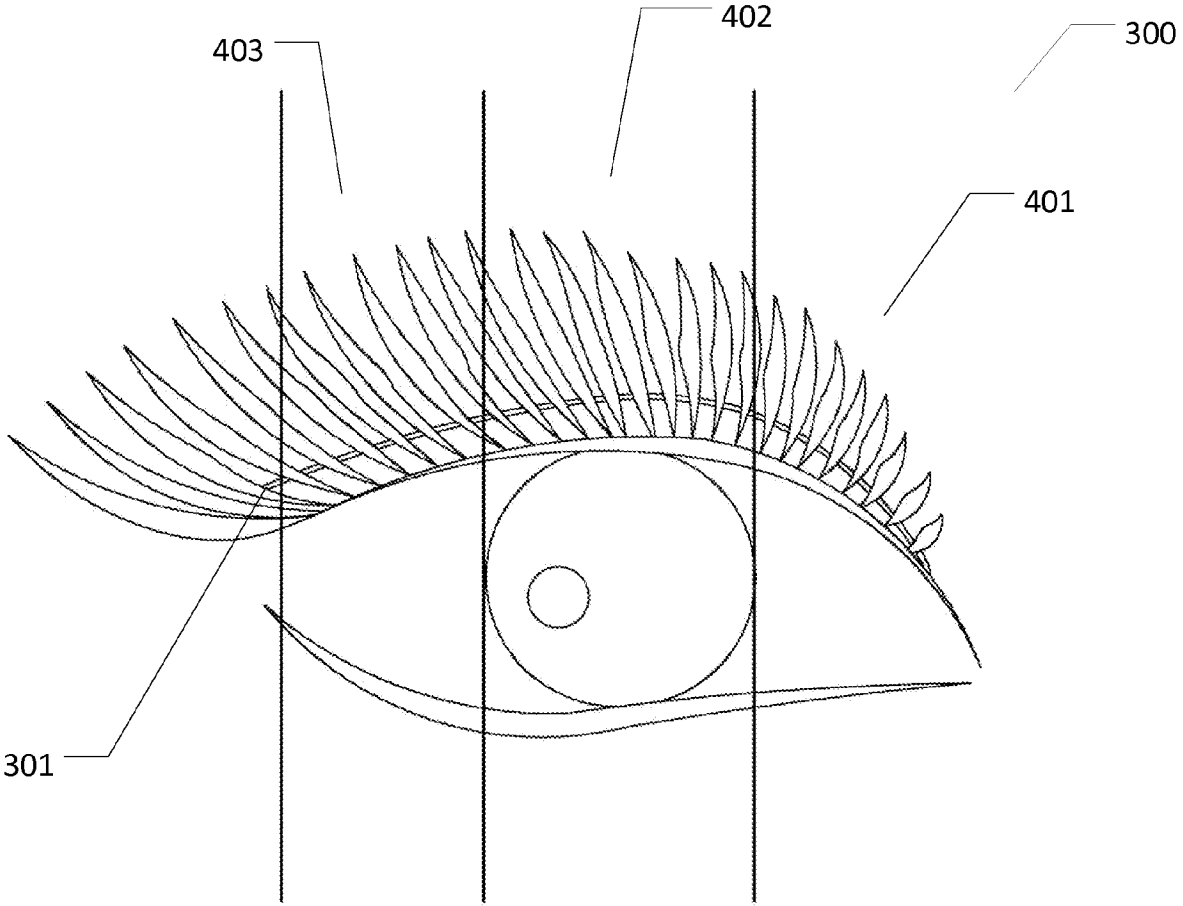
FIG. 4A illustrates how an eyelid can be divided into three zones.

FIG. 4A illustrates how eyelids 301 can be divided into three zones. In such embodiment, eyelids 301 can comprise an inner zone 401, middle zone 402, and outer zone 403. Inner zone 401 can be an area of eyelid 301 that can be near the tear ducts of eye 300. Middle zone 402 can be the center portion of eyelid 301 located just above the pupil. Outer zone 403 can be the portion of eyelid 301 farther from the tear ducts.

Figure 4B:
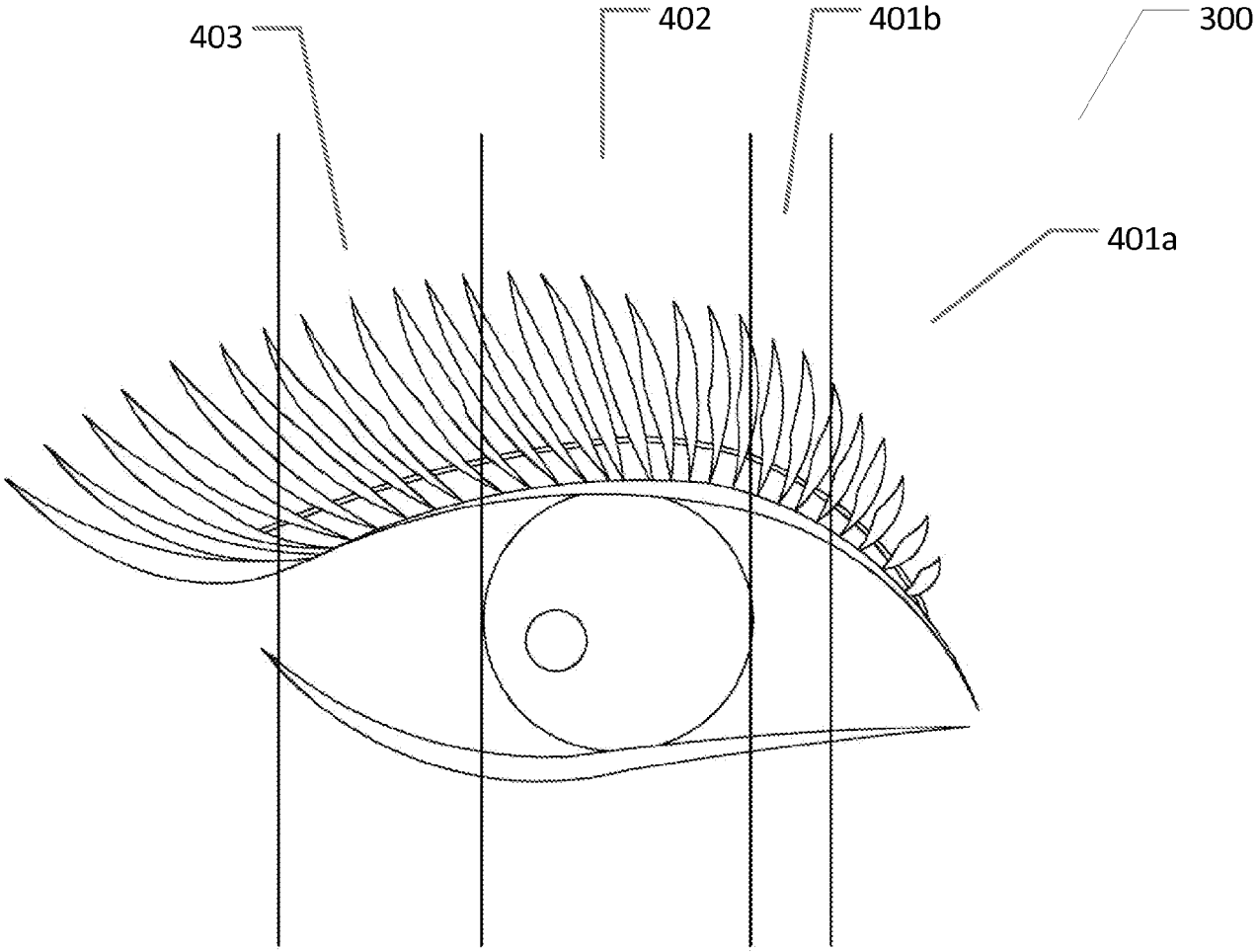
FIG. 4B illustrates how an eyelid can be divided into four zones.

FIG. 4B illustrates how eyelids 301 can be divided into four zones. In such embodiment, inner zone 401 can be divided into two sections. As such, inner zone 401 can comprise first inner zone 401*a*, and a second inner zone 401*b*. First inner zone 401*a* can be a portion closest to the tear ducts. Second inner zone 401*b* can be the portion connecting first inner zone 401*a* and mid-zone 402.

Figure 5A:
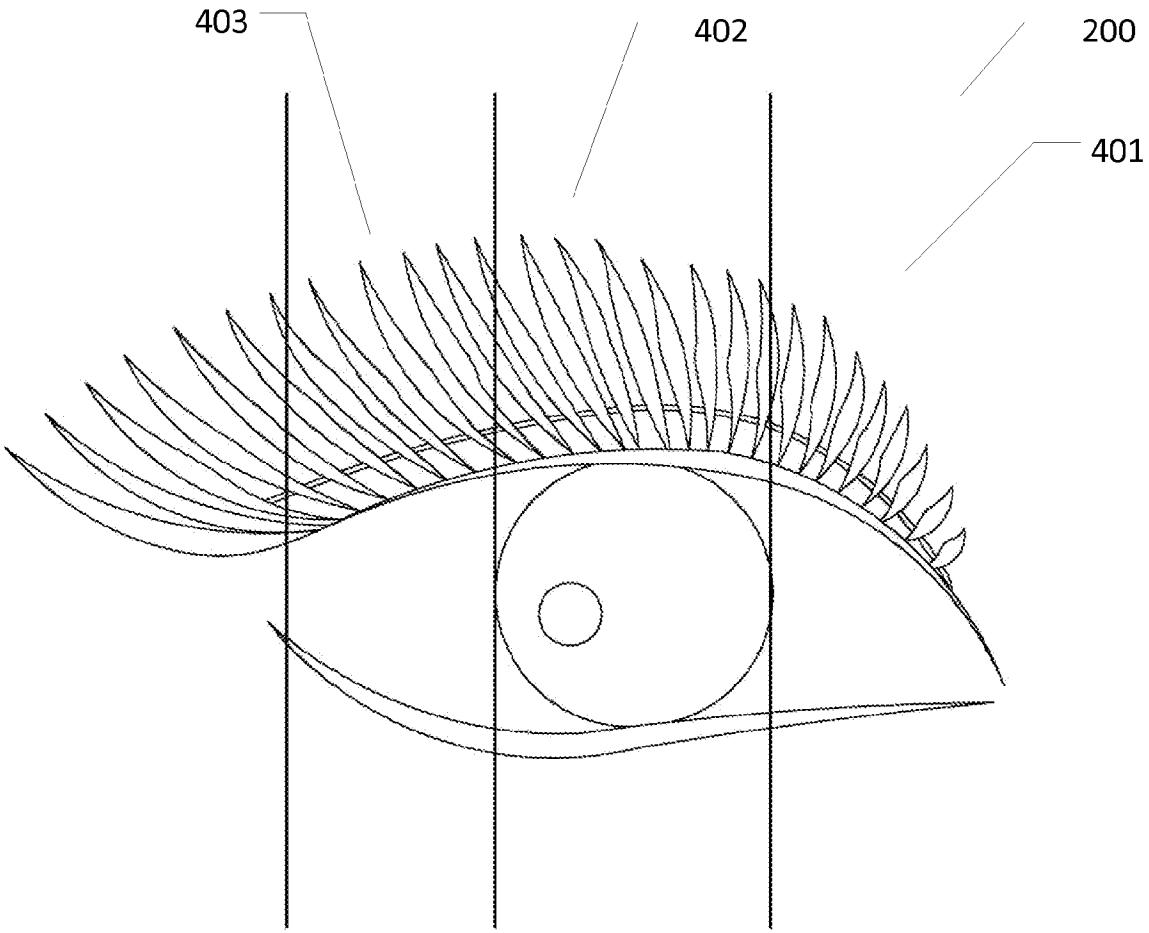
FIG. 5A illustrates how to make extension lashes appear natural when applied onto eyelashes.

FIG. 5A illustrates how to make extension lashes 200 appear natural when applied onto eyelashes 302. In such embodiment, extension lashes 200 can be attached on inner zone 401. Length extension lashes 200 with a length one-millimeter longer than the inner zone lashes can be applied to middle zone 402. Extension lashes 200 on outer zone 403 can be one-millimeter longer than middle zone 402. In one embodiment, inner zone 401 can comprise eight-millimeter extension lashes 200, middle zone 402 can have nine-millimeter extension lashes 200, and outer zone 403 can comprise ten-millimeter extension lashes.

Figure 5B:
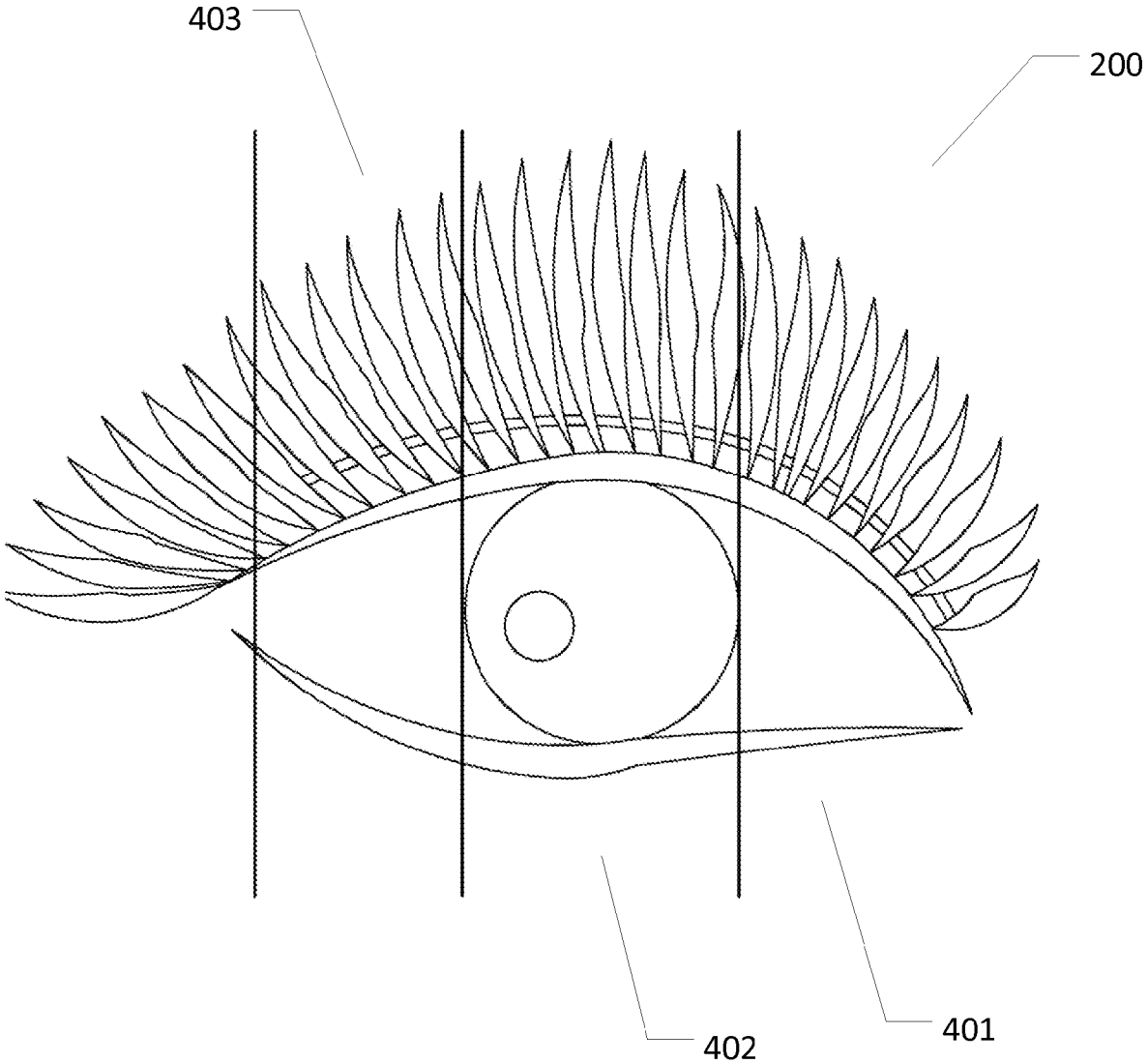
FIG. 5B illustrates application of extension lashes onto eyelashes to achieve a cute or doll-eyed look.

FIG. 5B illustrates application of extension lashes 200 onto eyelashes 302 to achieve a cute or doll-eyed look. In such embodiment, extension lashes 200 can be attached on inner zone 401. Length extension lashes 200, having a length that is two-millimeters longer than the inner zone lashes, can be applied to middle zone 402. Extension lashes 200 on outer zone 403 can be one millimeter shorter than the middle zone 402. As a non-limiting example, inner zone 401 can comprise eight-millimeter extension lashes 200, middle zone 402 can have ten-millimeter extension lashes 200, and outer zone 403 can comprise nine-millimeter extension lashes.

Figure 5C:
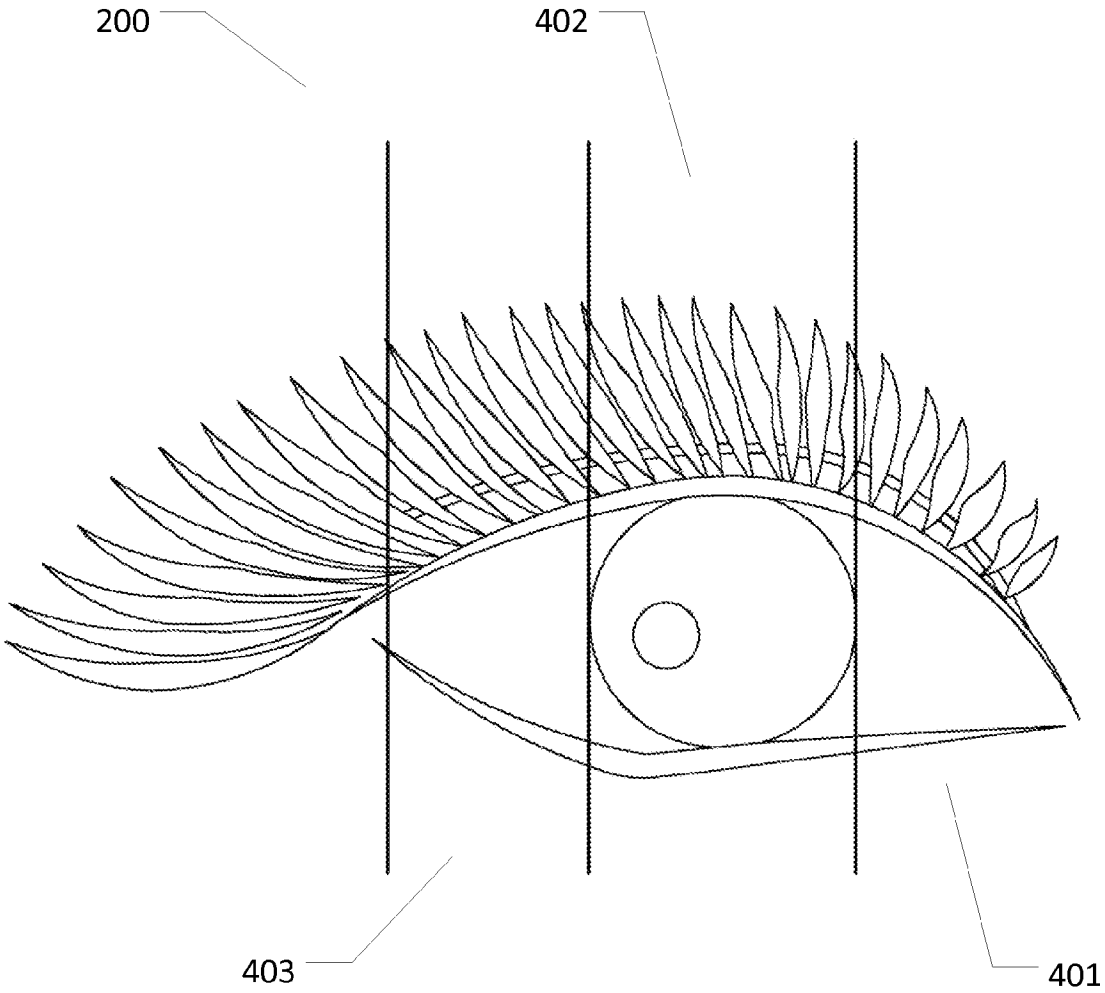
FIG. 5C illustrates application of extension lashes onto eyelashes to achieve a sexy look.

FIG. 5C illustrates application of extension lashes 200 on to eyelashes 302 to achieve sexy look. In such embodiment, extension lashes 200 can be attached on inner zone 401. Length extension lashes 200 having a length two-millimeter longer than the inner zone lashes can be applied to middle zone 402. Outer zone 403 extension lashes 200 can be two or three-millimeters longer than middle zone 402. As a non-limiting example, inner zone 401 can comprise eight-millimeter extension lashes 200, middle zone 402 can have ten-millimeter extension lashes 200, and outer zone 403 can comprise twelve or thirteen-millimeter extension lashes. Such applications of extension lashes 200 on eyes 300 can create a seductive look and make eyes 300 appear almond in shape.

Figure 5D:
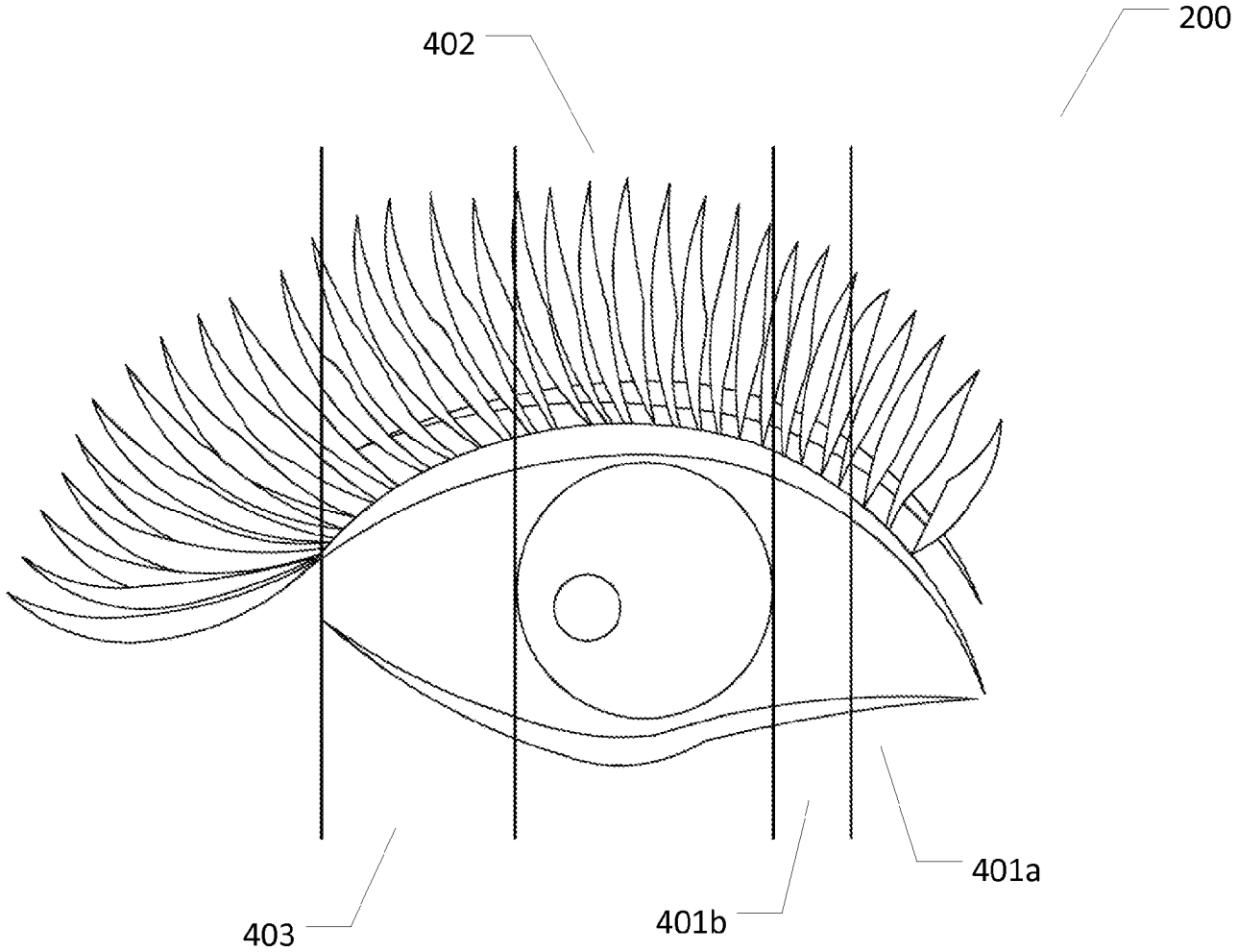
FIG. 5D illustrates application of extension lashes onto eyelashes to achieve a gorgeous look.

FIG. 5D illustrates application of extension lashes 200 onto eyelashes 302 to achieve a gorgeous look. In such embodiment, extension lashes 200 can be attached on first inner zone 401*a*. Length extension lashes 200 having a length one-millimeter longer than first inner zone lashes can be applied to second inner zone 401*b*. Length extension lashes 200 having a length one-millimeter longer than first inner zone lashes can be applied to second inner zone 401*b*. Length extension lashes 200 having a length one-millimeter longer than second inner zone lashes can be applied to middle zone 402. Outer zone 403 extension lashes 200 can be the same length as lashes of the middle zone 402. As a non-limiting example, first inner zone 401*a* can comprise eight-millimeter extension lashes 200, second inner zone 401*b* can comprise nine-millimeter lashes, middle zone 402 can have ten-millimeter extension lashes 200, and outer zone 403 can comprise ten-millimeter extension lashes. In such embodiment, eyes 300 can look more dramatic, attractive, and fuller.

For purposes of this disclosure, different thickness and curls of extension lashes 200 can be applied in different zones to achieve various looks for the user. To make eyes 300 appear larger and wider, thin and/or thick extension lashes 200 can be applied onto eyelashes 302. Additionally, extension lashes 200 can vary from curled to extra-curled to open up eyes 300 and make them appear larger. To make eyes 300 appear smaller, a thicker and/or extra-thick extension lashes 200 can be applied onto eyelashes 302. Selecting and applying more extension lashes 200 can make eyes 300 appear smaller and full.

Figure 6:
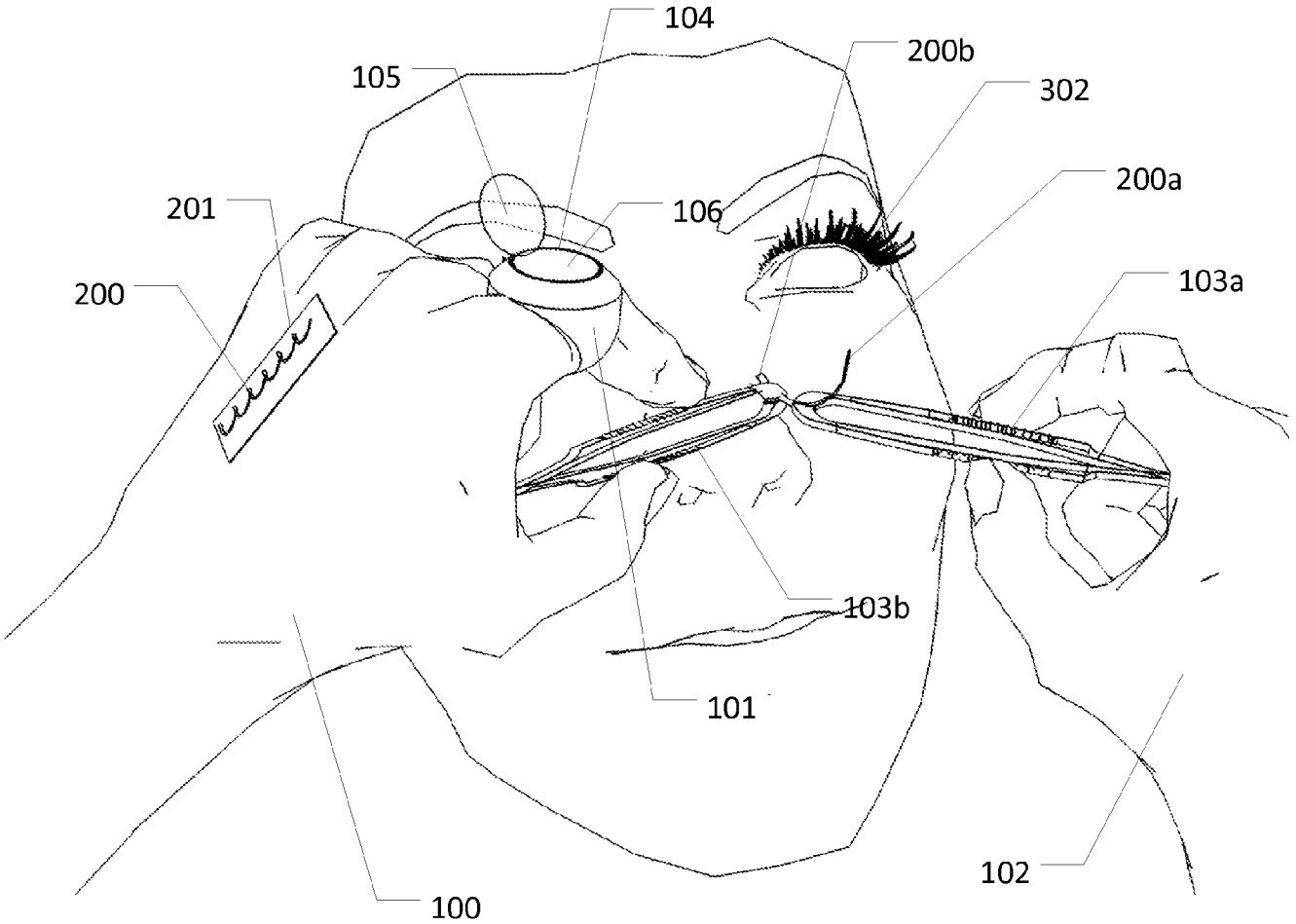
FIG. 6 illustrates how extension lashes can be applied to a plurality of natural eyelashes.

FIG. 6 illustrates how extension lashes 200 can be applied onto eyelash 302. Tape 201 can be placed on a portion of human face or at the back of first hand 100. Second hand 102 holding forceps 103 can be used to pick extension lashes 200 from tape 201. Extension lashes 200 can be picked using forceps 103 near the base 200*b*. As such, extension lashes 200 can be easily grasped, and directed into a desired area. Concurrently, first hand 100 wearing ring 101 can be moved towards second hand 102 in order to dip base 200*a* into container 104. As such, base 200*a* can be coated with glue 106. Further, base 200*a* can be attached near the bottom of single natural eyelash 302. Extension lashes 200 can be attached one at a time and/or per row on every individual natural eyelash 302.

In one embodiment, first hand 100 can hold forceps 103*b* and second hand 102 can hold first forceps 103*a*. First hand 100 can separate lashes on eye by using first forceps 103*b*. As first hand 100 adjusts space between lashes accordingly to clear space, second hand 102 can manipulate lash extension. Second hand 102 can use first forceps 103*a* to pick up lash off from strip, dip lash in adhesive/glue and apply lash to space created between lashes from first hand 100 using forceps 103*b*. In one embodiment, strip can be on the first hand 100 with ring 101. Tape 201 can be placed on a portion of user's face (such as on under-eye covering) or at the back of first hand 100. Second hand 102, using forceps 103*a* can pick an extension lash 200 from tape 201. Concurrently, first hand

100 wearing ring 101 can be moved towards second hand 102 in order to dip base 200*a* into container 104, coating base 200*a* with glue 106. Base 200*a* can then be attached near to natural eyelash 302.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A method of extending eyelashes to achieve a particular look comprising dividing a surface of an eyelid into clearly defined and substantially non-overlapping zones, said zones comprising an inner zone, a middle zone and an outer zone, said inner zone extends only from a tear duct to an iris, said middle zone extends completely and only across said iris, and said outer zone extends from the end of said iris until the end of said eyelid; and applying extension lashes to natural lashes within said zones, at least a portion of said extension lashes within said inner zone having a first length, said extension lashes within said middle zone having a second length; and said extension lashes within said outer zone comprising a third length.

2. The method of claim 1 wherein said second length is one millimeter longer than said first length, and said third length is one millimeter longer than said second length.

3. The method of claim 2 wherein said first length is eight millimeters, said second length is nine millimeters, and said third length is ten millimeters.

4. The method of claim 1 wherein said second length is two millimeters longer than said first length, and said third length is one millimeter shorter than said second length.

5. The method of claim 4 wherein said first length is eight millimeters, said second length is ten millimeters, and said third length is nine millimeters.

6. The method of claim 1 wherein said second length is two millimeter longer than said first length, and said third length is two millimeters longer than said second length.

7. The method of claim 6 wherein said first length is eight millimeters, said second length is ten millimeters, and said third length is twelve millimeters.

8. The method of claim 1 wherein said second length is two millimeter longer than said first length, and said third length is three millimeters longer than said second length.

9. The method of claim 8 wherein said first length is eight millimeters, said second length is ten millimeters, and said third length is thirteen millimeters.

10. The method of claim 1 wherein said inner zone is further divided into a first inner zone and a second inner zone, said first inner zone comprising lash extensions said first length, and said second inner zone comprising said lash extensions a fourth length.

11. The method of claim 10 wherein said fourth length is one millimeter longer than said first length, said second length is one millimeter longer than said fourth length, and said third length equal to said second length.

12. The method of claim 11 wherein said first length is eight millimeters, said fourth length is nine millimeters, said second length is ten millimeters, and said third length is ten millimeters.

13. The method of claim 1, wherein said extension lashes vary in thickness.

14. The method of claim 1, wherein said extension lashes vary in curl.

* * * * *